United States Patent [19]

Flynn

[11] 3,942,545

[45] Mar. 9, 1976

[54] GLASS WASHER AND CONDITIONER

[76] Inventor: Edward W. Flynn, 4051 South M-52, Owosso, Mich. 48867

[22] Filed: Sept. 10, 1974

[21] Appl. No.: 504,692

Related U.S. Application Data

[62] Division of Ser. No. 377,579, July 9, 1973, abandoned.

[52] U.S. Cl. ..... 134/46; 134/80; 134/152

[51] Int. Cl.[2] ..... B08B 3/02; B08B 9/08

[58] Field of Search ..... 134/46, 48, 57 R, 80, 81, 134/108, 152, 47, 170; 15/63

[56] References Cited

UNITED STATES PATENTS

| | | | |
|---|---|---|---|
| 724,734 | 4/1903 | Pindstofte | 134/46 X |
| 1,707,159 | 3/1929 | Burnham | 134/80 |
| 1,879,224 | 9/1932 | Hauk | 134/81 |
| 1,972,711 | 9/1934 | Kendall | 134/81 X |
| 3,094,997 | 6/1963 | Nolte et al. | 134/46 |
| 3,384,097 | 5/1968 | Meeker et al. | 134/46 |
| 3,731,696 | 5/1973 | Hackney | 134/80 |

*Primary Examiner*—Robert L. Bleutge

[57] ABSTRACT

A fully automatic washer for glassware that is activated on demand to continuously supply its delivery station with washed glasses. The apparatus is characterized by a turn table that receives glasses at a loading station and advances them through a spray curtain to be operated upon by circumferentially sequential pre-rinsing, wash, and final rinse stations; and after which the glasses eminate through a spray curtain to then successively engage a stop means which deactivates the apparatus until removal of said engaged glass or glasses, which reactivates the turn table to advance other glasses that have been placed in the loading station and advanced through the apparatus.

18 Claims, 10 Drawing Figures

GLASS WASHER AND CONDITIONER

This is a division of application Ser. No. 377,579, filed July 9, 1973, now abandoned.

BACKGROUND

The washing of large numbers of glasses or mugs and the like becomes a burdensome problem for hotels, drive inns, bars, lounges, restaurants, hospitals, and such institutions in general. Cleaning is a primary object while a standard of sterilization must be complied with followed by conditioning for reuse. The cleaning requires removal of all foreign matter such as lipstick, and residue from foods such as buttermilk and juices or dried pulp deposits. The sterilization is standardized by washing with water containing chemicals maintained at 140° F. And, the conditioning requires the return of the washed and sterilized glasses to room temperature or less as circumstances require. These requirements are met with by the present invention which provides a compact and fully automatic washer that eliminates all hand operations. With the present invention, there is a cold pre-rinse followed by a wash with a chemical sprayed under pressure onto the glasses at the high temperature to thoroughly cleanse them, and thereafter a cold rinse with disinfectant conditions the glasses so that they are immediately reuseable.

Heretofore, glass washers have been cumbersome machines with separation of the various functional requirements, such as separate chambers or separate time intervals for the process of pre-rinse, washing, and final rinsing. Consequently, the usual machine is either expensive or complicated and requires sophisticated control means to govern the cycles of the process, and all of which requires the constant attention of an operator. Therefore, it is a general object of this invention to provide a compact glass washer that operates automatically without attention. With the present invention there is a circular turn table or turret which revolves on demand through functional stations including a loading station, a pre-rinse station, a washing station, a final rinse station and a delivery station. These stations are arranged in circular sequence and operation is effected by removing washed glasses from the delivery station, and full capacity operation is effected by maintaining a full condition at the loading station.

This glass washer is a self-contained apparatus operable on demand to simultaneously perform all functions involved. Water is sprayed under pressure throughout the rinse and wash stations, and it is an object of this invention to separate these wet stations from the dry loading and delivery stations. With the present invention spray curtains are provided to establish this separation and through which the glasses are moveable with freedom. Further, a characteristic feature of the present invention which simplifies the apparatus greatly is the lack of physical barriers between the rinse and wash stations that are circumferentially contiguous.

The control of glass washers is usually by complex control means, or manually, it being an object of this invention to provide an automatic command means which governs all functions of the apparatus. With the present invention there is a shut-off bar or rod that is disengageable from a delivered glass by removing the latter and which activates the apparatus to advance another glass into engagement therewith, during which time interval the entire apparatus is in operation.

Glass washers of the type under consideration are supplied with hot and cold running water under moderate pressure and with electrical energy for motivation. Also, supplies of sterilizer and detergent are drawn from reservoirs and metered into the waters that are discharged onto the glassware. It is an object of this invention to advantageously employ the usual hot and cold water supply for the moderate pressure required of the rinsing functions, and to generate high water pressure to meet the requirements of effective washing by means of spraying. It is also an object to advantageously employ this low and high pressure available to the rinse and wash stations by supplying these separate functions with sterilizer and detergent separately applied, respectively.

With an apparatus as generally stated above, it is also an object to provide a basin with station separation for the collection and recycling of a greater portion of wash water with detergent, with a drain for the rinse water with disinfectant, and all to the end that the heated wash water and detergent is conserved while the cold rinse water and disinfectant is expanded with but a small percentage of said wash water that is replenished in a fluid controlled tank.

It is an object of the present invention to provide a glass washing apparatus of the character referred to that efficiently washes glassware installed thereon invertedly and adapted to "drip dry", there being a disposition of spray tubes or nozzles that are conducive to thorough cleaning. Make-up hot water is automatically added to the pumping system of the wash-detergent, while the temperature and spraying pressures of both rinse and wash waters is set or adjusted as required. Safety and sanitation are primary objects of this invention, there being no dangerous operation of components, and the working parts are self-cleaning and readily accessible for inspection and maintenance.

DRAWINGS

The various objects and features of this invention will be fully understood from the following detailed description of the typical preferred form and application thereof, throughout which description reference is made to the accompanying drawings, in which.

Figure 1:
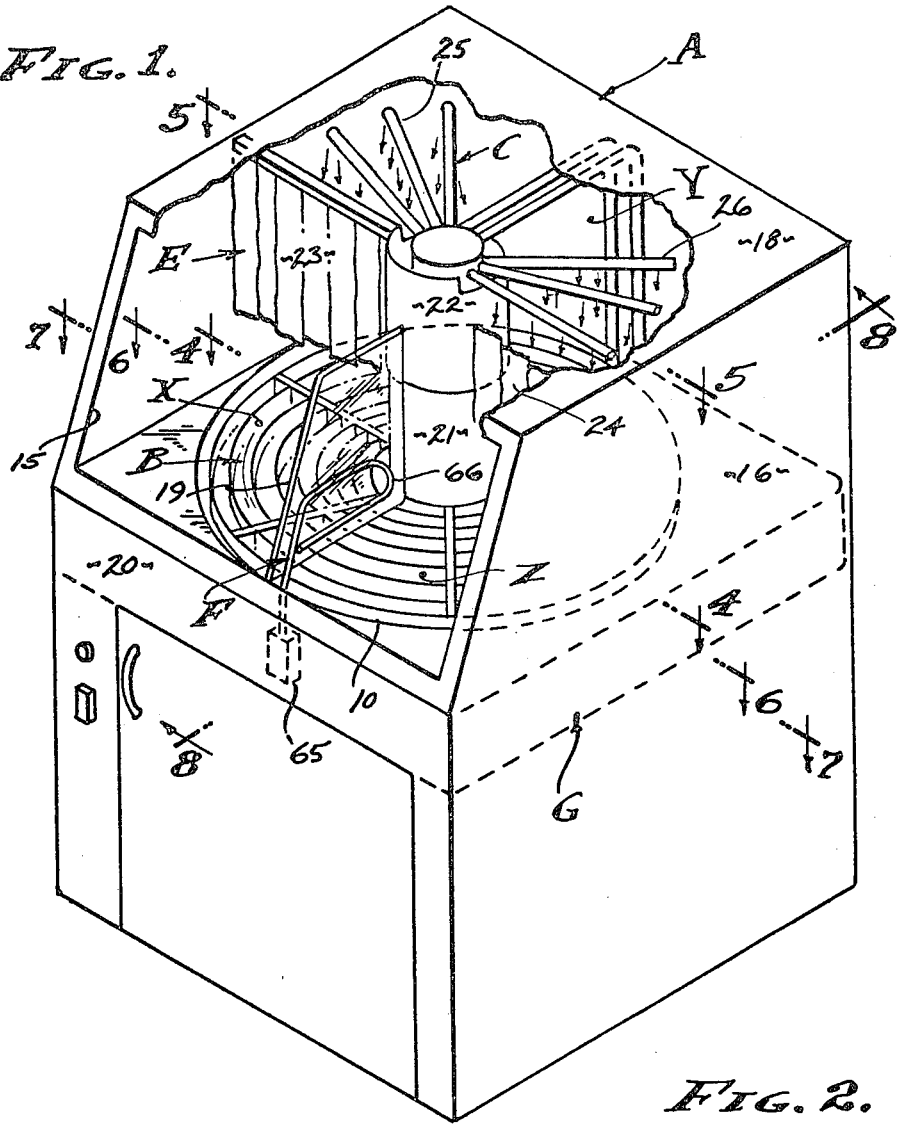
FIG. 1 is a perspective view of the glass washer and conditioner with a portion of the housing broken away in order to show the wash elements.
Figure 2:
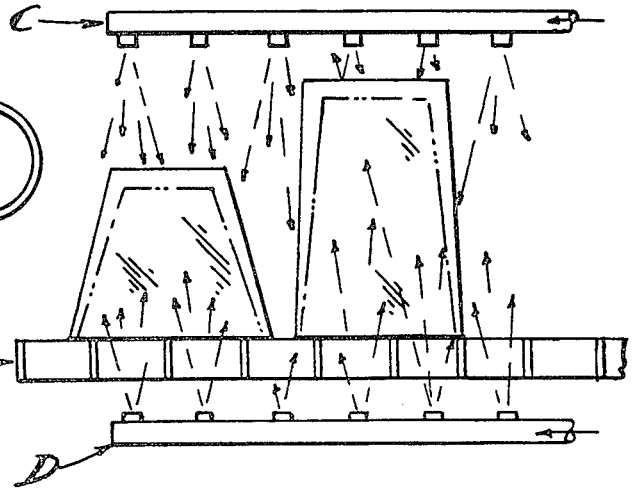
FIG. 2 is an enlarged fragmentary view of the upper and lower wash tubes with glassware disposed therebetween in inverted positions upon the turn table.
Figure 3:
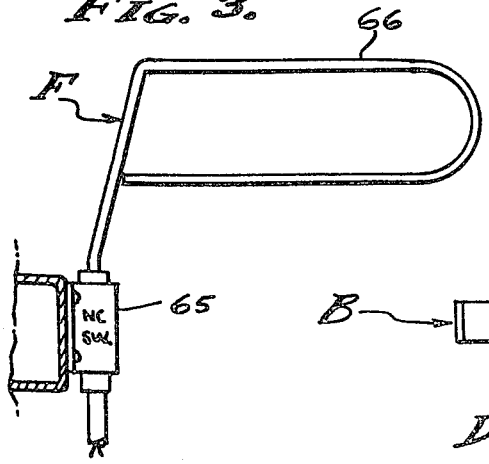
FIG. 3 is an enlarged detailed fragmentary view of the command element which operates a switch that deactivates the apparatus when engaged by advanced glassware.
Figure 4:
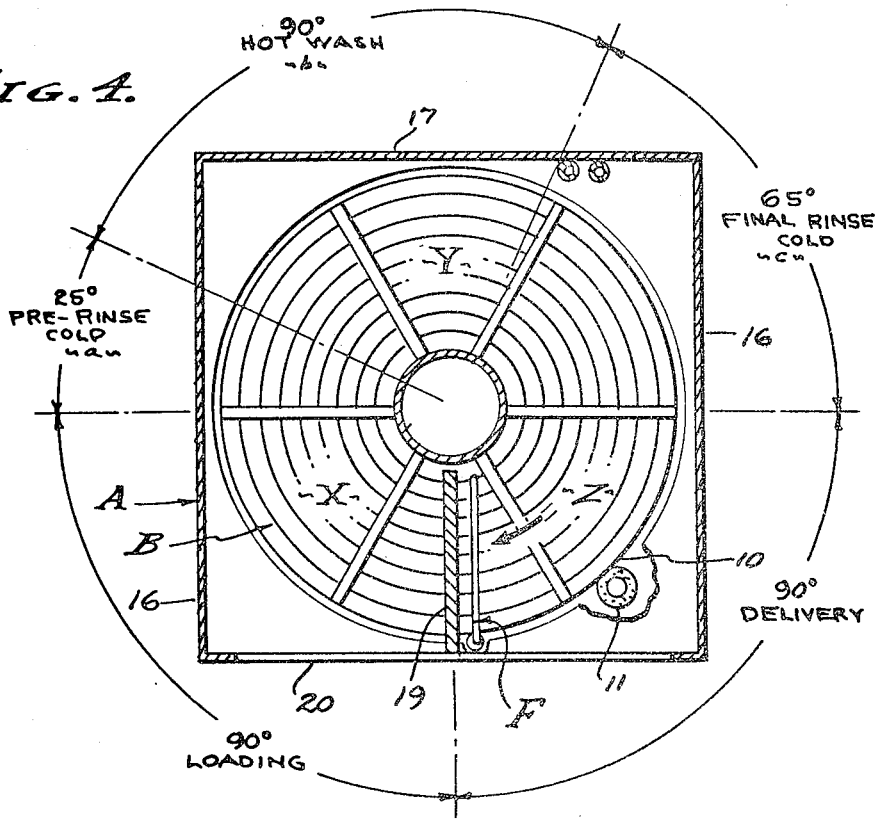
Figure 5:
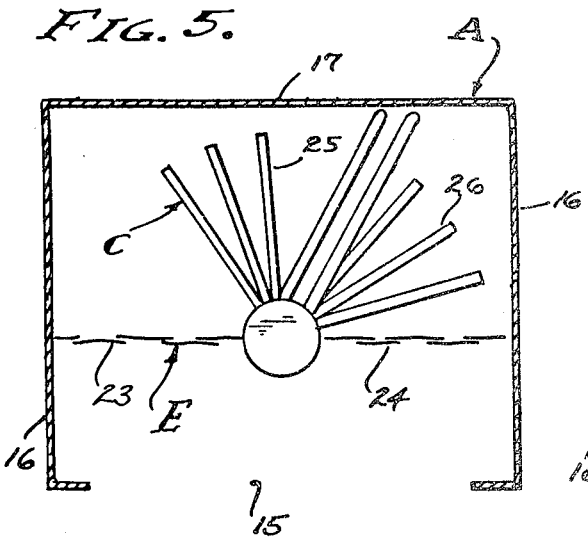
Figure 6:
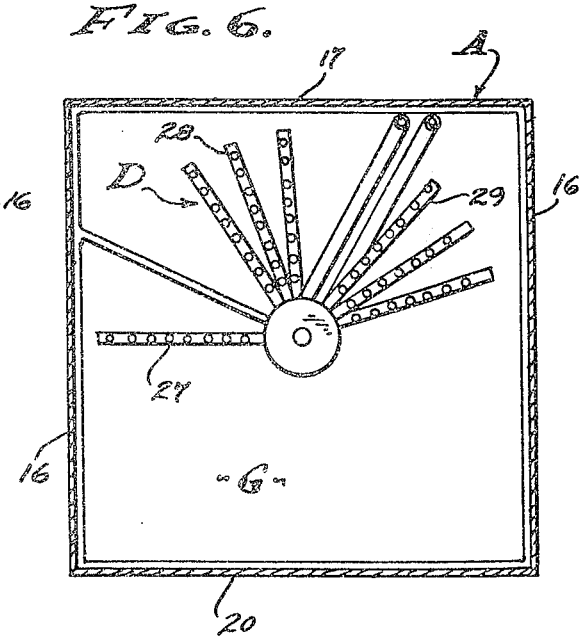
Figure 7:
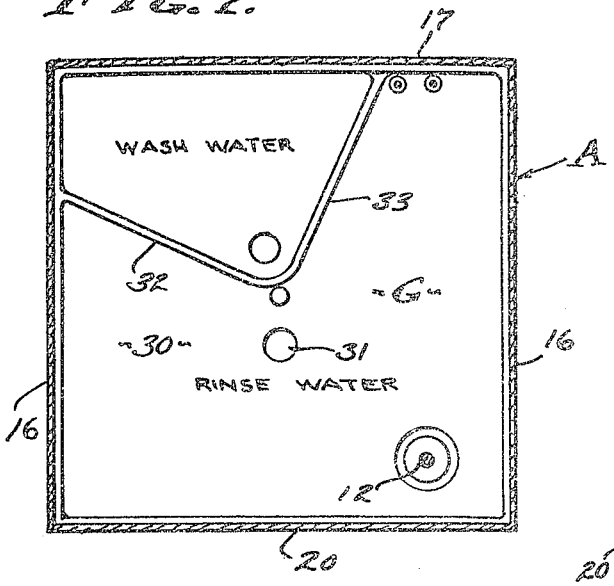

FIGS. 4, 5, 6 and 7 are plan sections taken substantially as indicated by lines 4—4, 5—5, 6—6 and 7—7 on FIG. 1.

Figure 8:
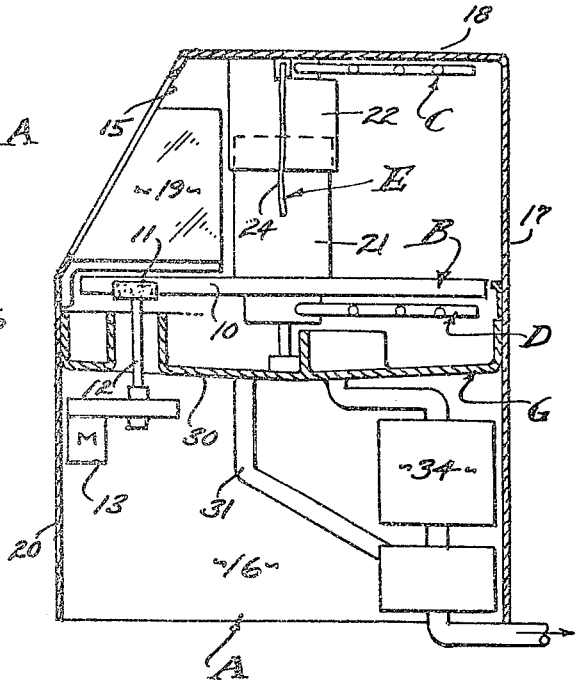

FIGS. 8 is a general side elevation section of the apparatus and taken as indicated by line 8—8 on FIG. 1.

Figure 9:
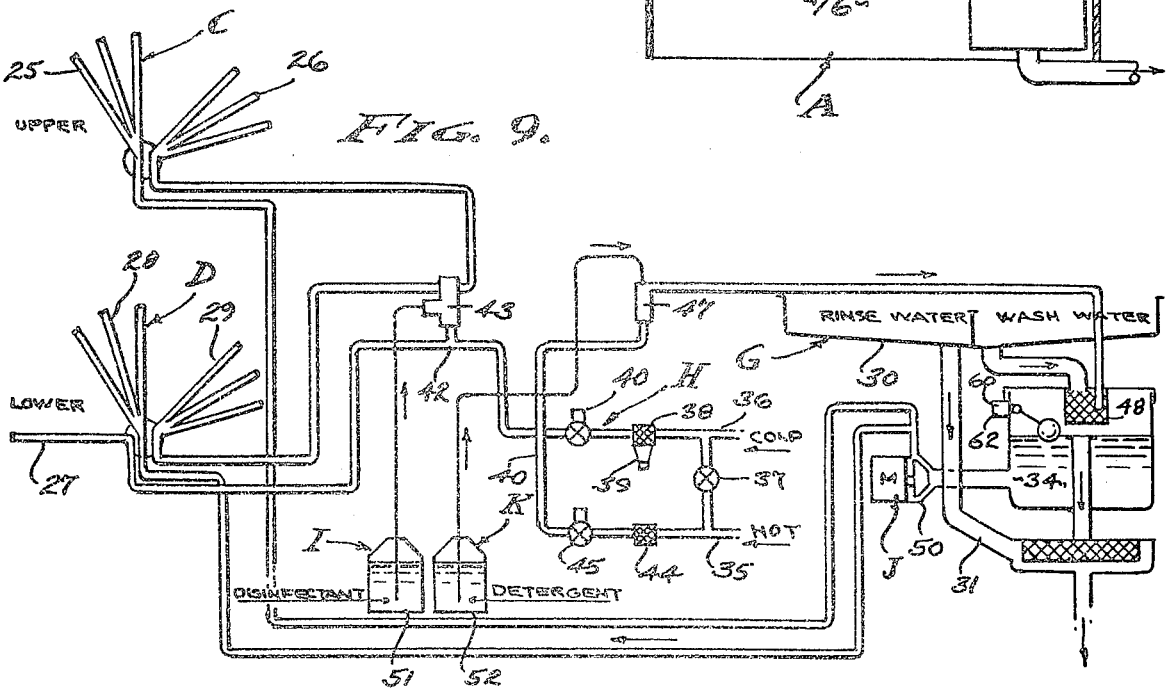
Figure 10:
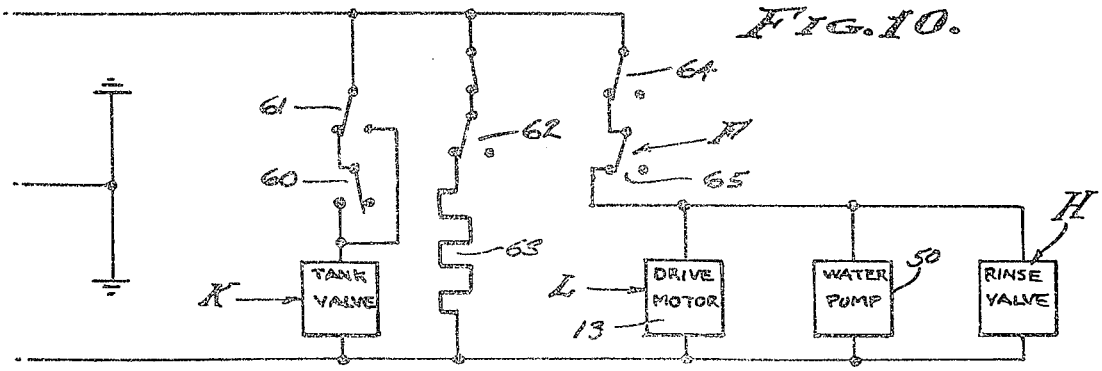

FIG. 9 is a plumbing schematic of the elements involved in the apparatus, and FIG. 10 is an electrical schematic of the elements involved in the apparatus.

PREFERRED EMBODIMENT

The glass washer and conditioner is shown as involving a housing-frame A of square plan configuration with a front access opening at counter height. The upper portion of the housing is occupied by a turn table B, upper and lower spray tubes C and D, a spray curtain E and a separator command means F; while the lower portion of the housing is separated from the upper portion by a tray or basin G and is occupied by the various components including a rinse water supply means H with its sterilizing supply means I, a wash water supply means J with its detergent supply means K, and by a drive means L for motivating the turn table B. The above enumerated elements of the device are arranged and related as shown in the drawings and as will now be described: The housing-frame A is square in plan configuration to receive the circular turn table B with some side clearance, bearing means rotatably supporting the turn table on a central vertical axis to revolve in a plane spaced above the basin G. The turn table B is a perforated wheel and presents a supporting grill upon which the glassware is placed in an inverted position, with the lips down and bottoms up. The rim 10 thereof is driven through drive means L by a rubber tyred roller 11 that is turned by a parallel shaft 12 journaled in one corner of the housing and revolved by a motor 13 of the drive means L. Thus, the turn table revolves advancively in a clockwise direction when the motor 13 is activated to drive the same through the roller 11, and spray is free to penetrate the grill of the turn table from beneath and to enter the glassware interiors, and to pass downwardly over the same for subsequent collection in the basin G. In practice, a gear head motor 13 is employed with a speed reducing chain drive to shaft 12, and the roller 11 is of small diameter relative to the large diameter of turn table B, and all to the end that it advances slowly.

In accordance with this invention, there is a semi-circular tunnel provided within the confines of the upper portion of the housing-frame A and defined by a front opening 15 and closed imperforate sides 16, back 17 and top 18. The grilled supporting plane of the turn table operates at or somewhat below the horizontal edge of opening 15, there being a divider 19 secured to the top 18 or front 20 and disposed in a vertical plane free of the turn table so as to establish a loading station X to the left and a delivery station Z to the right. In practice the loading and delivery stations each extend through an arc of 90° with their circumferential extent determined by the spray curtain E which extends diametrically through the center axis of rotation and between the opposite sides 16 of the housing. The spray curtain E establishes a rinse and wash chamber Y within the housing-frame A and which extends through the remaining arc of 180° and which is divided into a pre-rinse station *a* through an arc of 25°, followed by a wash station *b* through an arc of 90°, and then followed by a final rinse station *c* through an arc of 65°. A feature is the lack of physical division between the stations *a*, *b* and *c*, the semi-circular tunnel formed thereby being continuous from the curtain E at station X to the curtain E at station Z.

The spray curtain E can vary in form, the height of the tunnel can be varied, and the useable radius of the turn table B can be determined in various ways. In practice, the useable radius of the turn table is determined by a cylindrical column 21–22 on the center axis of the housing and about which the glassware is conveyed by the advancing turn table upon which they are inverted. The column sections 21 and 22 are telescopically related one section 21 carried by the turn table B and the other section 22 coaxially depending from the top 18. Vertical adjustability is obtained by elevating the turn table to the desired height and by setting its position with respect to top 18 as by means of set screws on its supporting shaft. Accordingly, the spray curtain E is divided into entry and exit sections 23 and 24, each made up of depending ribbons of flexible overlapped or slitted material substantially occupying the opening between the turn table and top 18. In practice, a bar secured to the top 18 supports each curtain section.

Referring now to the upper and lower spray tubes C and D, the said upper spray tubes C are disposed beneath the top 18 to spray downwardly over the glassware, while the said lower spray tubes D are disposed under the turn table B to spray upwardly into the interior of the glassware. In accordance with this invention, there is one or more spray tubes C and D at each station *a*, *b* and *c* of the processing tunnel, and each plumbed for its function to rinse or wash. In practice, the upper spray tubes C involve two groups of tubes; a first group of three wash tubes 25 centered over the wash station *b* and spaced 15° apart; and a second group of three rinse tubes 26 centered over the final rinse station *c* and spaced 15° apart. The tubes 25 and 26 project radially from the central axis to the perimeter of the turn table B and each has a multiplicity of downwardly directed nozzles. The lower spray tubes D involve three groups of tubes; a pre-rinse tube 27 juxtapositioned to the pre-rinse station *a* at the entry section 23 of the spray curtain E and within the processing tunnel; a first group of three wash tubes 28 centered under the wash station *b* and spaced 15° apart; and a second group of three rinse tubes 29 centered under the final rinse station *c* and spaced 15° apart. The tubes 27, 28 and 29 project radially from the central axis to the perimeter of the turn table B and each has a multiplicity of upwardly directed nozzles.

The tray or basin G underlies the aforementioned apparatus located in the upper portion of the housing-frame A. As shown, the basin G is a coextensive partition that is horizontally disposed with a bottom 30 pitched to a drain 31 for discharging of rinse waters, and with spaced baffles 32 and 33 segregating a portion of the bottom pitched to a transfer line into a reservoir tank 34 of the wash water supply means J later to be described. Therefore, there is a separation of spray waters whereby the cold expendable rinse waters are discharged and the heated wash water conserved, it being understood that a percentage of wash water will be exposed to and mixed with and/or condensed into the next adjacent rinse waters.

Referring now to the plumbing diagram of FIG. 9, the relationship of rinse water supply means H with its sterilizing supply means I and wash water supply means J with its detergent supply means K is illustrated. Firstly, there are hot and cold water supply connections 35 and 36 delivering water at moderate pressure which normally varies. The said two connections continue separately into the hot wash and cold rinse means J and H, there being a bypass valve 37 by which the cold water can be tempered as required.

The cold rinse water (tempered) is passed through a filter 38 and is pressure controlled by a regulator 39. A normally closed solonoid valve 40 opens into a rinse water line 41 which directs the same through a divider 42. The divider 42 separates flow to the lower spray tube 27 and to a mixing valve 43 that admixed liquid disinfectant to the rinse water which is then directed to the rinse tubes 26 and 29 of the upper and lower spray tubes B and D respectively.

The hot wash water is free to flow at full supply pressure without drawing cold water through valve 37 and is passed through a filter 44. A normally closed solonoid valve 45 opens into wash water line 46 which directs the same through a mixing valve 47 that admixed liquid detergent to the wash water which is then directed into the reservoir tank 34 through a screen 48. A motor driven pump 50 draws from the tank of hot wash water and detergent and directs the same to the wash spray tubes 25 and 28 of the upper and lower spray tubes C and D.

The mixing valves 43 and 47 can be siphon valves responsive to flow in the rinse water and wash water lines to draw disinfectant and detergent from their respective reservoirs 51 and 52. Needle valves can be used to control the admixtures.

Referring now to the electrical diagram of FIG. 10, the relationship of rinse and wash water control to the delivery of clean glassware is illustrated. In particular, it is the command means F that is shown and its automatic control over the wash and rinse processes. The hot water solenoid valve 45 is controlled by a nornally closed switch 60 opened by a float in reservoir tank 34 when a maximum level is reached, and a manual switch 61 bypasses this circuit for servicing operation. A normally closed switch 62 is opened by said float in reservoir tank 34 when a minimum level is reached thereby controlling a heater 63 that is designed to maintain a 140° F. Temperature when immersed in the wash water and detergent. The cold water valve 43, motor of pump 50 and drive motor 15 for the turn table B are all under control of a main switch 64 in series with a normally closed limit switch 65 which is the command means element that deactivates the apparatus when the wash and rinse processes are completed upon any glassware passing therethrough. In accordance with the invention, the separator command means F involves a gate which can comprise the divider 19, or preferably a swinging bar or rod 66 that is moveably responsive to engagement by glassware advanced by the turn table B. Consequently, engagement by any glassware advanced into the rod 66 moves the same so as to activate the switch 65 into an open condition. Subsequently, removal of said glass permits the switch to close and thereby reactivate the aforementioned electrical circuits, thereby causing full operation of the apparatus and all of which occurs automatically upon demand.

Having described only a typical preferred form and application of my invention, I do not wish to be limited or restricted to the specific details herein set forth, but wish to reserve to myself any modifications or variations that may appear to those skilled in the art:

I claim:

1. Apparatus for automatically washing glassware on demand and including; a housing defining a chamber with a frontal opening, a turn table journaled on a vertical axis and disposed to advancively support glassware on a horizontally disposed plane within the confines of said chamber, normally operable drive means advancively rotating the turn table, a spray curtain of flexible material penetrable by said glassware advanced therethrough upon the turn table and recessed toward said axis dividing the chamber into a rearmost wash tunnel and foremost loading and delivery stations accessible through said frontal opening and contiguous to opposite entry and exit portions of the spray curtain respectively, separator command means dividing said frontal opening into said loading and delivery stations and responsive to glassware advanced thereto and to stop the said drive means, and wash means processing the glassware loaded upon the turn table at the foremost station and advanced thereby through the rearmost wash tunnel, removal of said advanced glassware from the separator command means permitting normal operation of the drive means to advance the turn table.

2. The demand operable glassware washing apparatus as set forth in claim 1 wherein the command means comprises an element disengageable from the said glassware advanced thereto.

3. The demand operable glassware washing apparatus as set forth in claim 1 wherein the separator command means comprises a responsively engageable bar disposed radially over the turn table and disengageable from the said glassware advanced thereto.

4. The demand operable glassware washing apparatus as set forth in claim 1 wherein the separator command means comprises a yieldingly shiftable bar disposed radially over the turn table and releasably disengageable from the said glassware advanced thereto.

5. The demand operable glassware washing apparatus as set forth in claim 1 wherein the separator command means comprises a vertically and radially disposed partition separating said loading and delivery stations.

6. The demand operable glassware washing apparatus as set forth in claim 1 wherein the separator command means comprises, a vertically and radially disposed partition separating said loading and delivery stations, and a glassware responsive element at the delivery station side thereof.

7. The demand operable glassware washing apparatus as set forth in claim 1 wherein the separator command means comprises, a vertically and radially disposed partition separating said loading and delivery stations, and a responsively engageable element and delivery station side thereof disengageable from the said glassware advanced thereto.

8. The demand operable glassware washing apparatus as set forth in claim 1 wherein the separator command means comprises, a vertically and radially disposed partition separating said loading and delivery stations, and a responsively engageable bar at the delivery station side thereof disposed radially over the turn table and disengageable from the glassware advanced thereto.

9. The demand operable glassware washing apparatus as set forth in claim 1 wherein the separator command means comprises, a vertically and radially disposed partition separating said loading and delivery stations, and a yieldingly shiftable bar at the delivery station side thereof and disposed radially over the turn table and releasably disengageable from the said glassware advanced thereto.

10. Apparatus for automatically washing glassware on demand and including; a housing defining a chamber with a frontal opening, a turn table journaled on a vertical axis and disposed to advancively support glassware on a horizontally disposed plane within the confines of said chamber, normally operable drive means advancively rotating the turn table, a vertical column disposed through the chamber on the central axis, entry and exit spray curtains of flexible material penetrable by said glassware advanced therethrough upon the turn table and extending radially from said column closing a semi-circular rearmost wash tunnel extending therebetween and exposing foremost loading and delivery stations accessible through said frontal opening, separator command means dividing said frontal opening into said loading and delivery stations and responsive to glassware advanced thereto to stop the said drive means, and wash means processing the glassware loaded upon the turn table at the foremost station and advanced thereby through the rearmost wash tunnel, removal of said advanced glassware from the separator command means permitting normal operation of the drive means to advance the turn table.

11. The demand operable glassware washing apparatus as set forth in claim 10 wherein the separator command means comprises an element disengageable from the said glassware advanced thereto.

12. The demand operable glassware washing apparatus as set forth in claim 10 wherein the separator command means comprises a responsively engageable bar disposed radially over the turn table and disengageable from the said glassware advanced thereto.

13. The demand operable glassware washing apparatus as set forth in claim 10 wherein the separator command means comprises a yieldingly shiftable bar disposed radially over the turn table and releasably disengageable from the said glassware advanced thereto.

14. The demand operable glassware washing apparatus as set forth in claim 10 wherein the separator command means comprises a vertically and radially disposed partition separating said loading and delivery stations.

15. The demand operable glassware washing apparatus as set forth in claim 10 wherein the separator command means comprises, a vertically and radially disposed partition separating said loading and delivery stations, and a glassware responsive element at the delivery station side thereof.

16. The demand operable glassware washing apparatus as set forth in claim 10 wherein the separator command means comprises, a vertically and radially disposed partition separating said loading and delivery stations, and a responsively engageable element and delivery station side thereof disengageable from the said glassware advanced thereto.

17. The demand operable glassware washing apparatus as set forth in claim 10 wherein the separator command means comprises, a vertically and radially disposed partition separating said loading and delivery stations, and a responsively engageable bar at the delivery station side thereof disposed radially over the turn table and disengageable from the glassware advanced thereto.

18. The demand operable glassware washing apparatus as set forth in claim 10 wherein the separator command means comprises, a vertically and radially disposed partition separating said loading and delivery stations, and a yieldingly shiftable bar at the delivery station side thereof and disposed radially over the turn table and releasably disengageable from the said glassware advanced thereto.

* * * * *